US005199531A

United States Patent [19]

Malin

[11] Patent Number: 5,199,531

[45] Date of Patent: Apr. 6, 1993

[54] RAIL-MOUNTED, HIGH-LIFT STACKING VEHICLE

[75] Inventor: Peter Malin, Wolfurt, Austria

[73] Assignee: Lagertechnik Gesellschaft M.B.H., Wolfurt, Austria

[21] Appl. No.: 776,328

[22] PCT Filed: Jun. 15, 1990

[86] PCT No.: PCT/AT90/00063

§ 371 Date: Dec. 11, 1991

§ 102(e) Date: Dec. 11, 1991

[87] PCT Pub. No.: WO91/01265

PCT Pub. Date: Feb. 7, 1991

[30] Foreign Application Priority Data

Jul. 19, 1989 [AT] Austria ..... 1740/89

[51] Int. Cl.[5] ..... B66B 9/20

[52] U.S. Cl. ..... 187/9 R; 414/281; 105/165

[58] Field of Search ..... 187/9 R, 9 E; 414/281, 414/282, 283; 280/410, 134; 105/165, 167

[56] References Cited

U.S. PATENT DOCUMENTS

| | | | |
|---|---|---|---|
| 553,268 | 1/1896 | Skou | 105/165 |
| 1,826,853 | 10/1931 | Williams et al. | 280/410 |
| 2,071,207 | 2/1937 | Knecht | 105/165 |
| 4,010,855 | 3/1977 | Smith | 414/281 |
| 4,331,418 | 5/1982 | Klebe | 414/282 |

FOREIGN PATENT DOCUMENTS

| | | | |
|---|---|---|---|
| 3446310 | 6/1986 | Fed. Rep. of Germany | 414/281 |

*Primary Examiner*—Robert P. Olszewski
*Assistant Examiner*—Kenneth Noland
*Attorney, Agent, or Firm*—Notaro & Michalos

[57] ABSTRACT

A rail-mounted, high-lift stacking device (1) comprises a travelling mechanism (13) with at least two travelling mechanism bodies (6) of which each is provided with at least one travelling roller (7). Furthermore, the shelf-stacking device (1) has an upper guide mechanism (3) with a front and a rear guide arrangement, wherein between the travelling mechanism (13) and the guide mechanism (3) at least one lift mast (2) is placed on which a lift carriage (14) is supported so as to be vertically drivable. The travelling mechanism (13) and the guide mechanism (3) are provided with at least one articulation (20) permitting bending in a horizontal plane.

10 Claims, 10 Drawing Sheets

Fig. 1 (PRIOR ART)
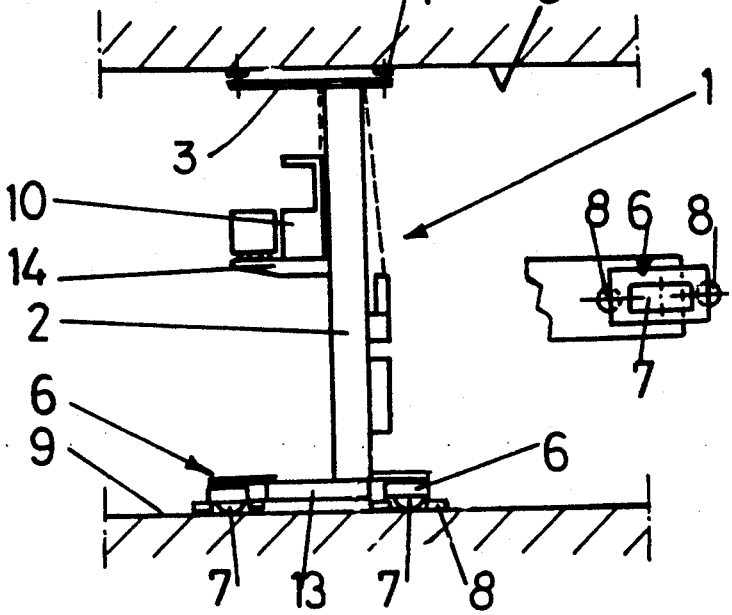
Fig. 1a (PRIOR ART)
Fig. 2 (PRIOR ART)
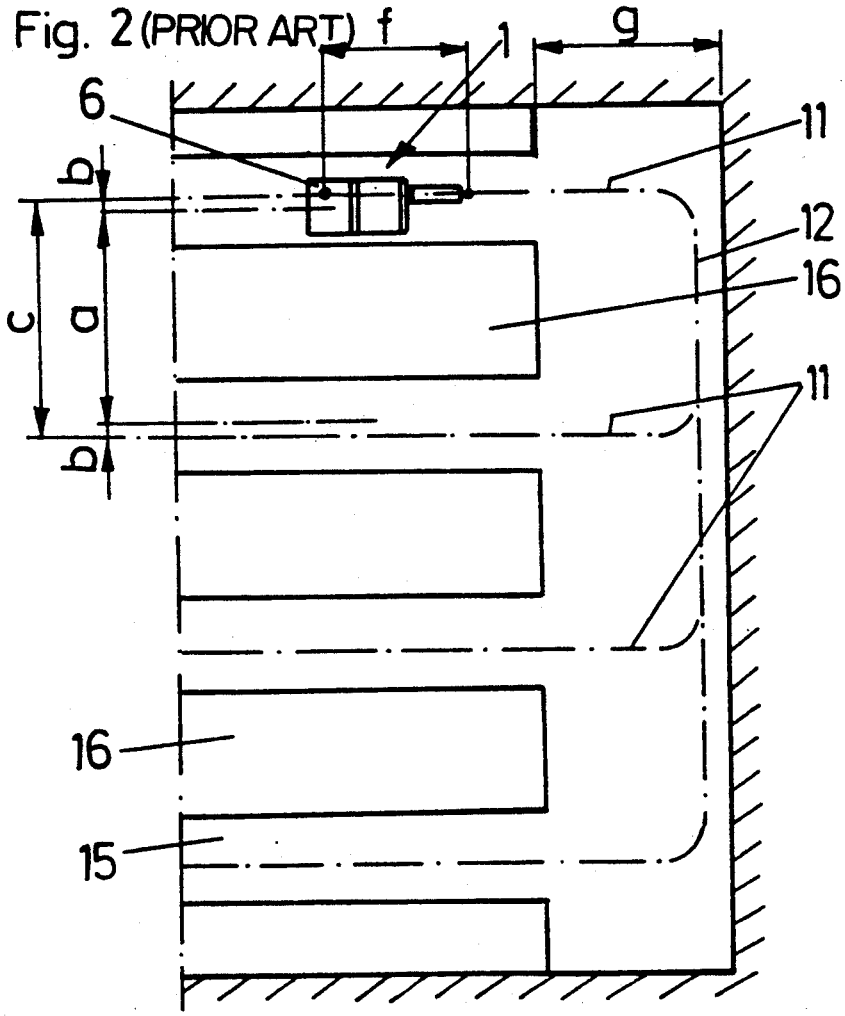

RAIL-MOUNTED, HIGH-LIFT STACKING VEHICLE

FIELD AND BACKGROUND OF THE INVENTION

The invention relates to a rail-mounted high-lift stacking vehicle comprising a travelling mechanism with at least two travelling mechanism bodies. Each body has at least one travelling roller each and an upper guide mechanism with a front and a rear guide arrangement. At least one lift mast is provided between the travelling mechanism and the guide mechanism, on which is supported a vertically displaceable lift carriage.

A vehicle of this type is known, for example, from European Patent 148 913.

Such vehicles are guided on rails in the aisles between storage shelves. So that a vehicle is in to an position to enter from one aisle the adjacent aisle, it is necessary that the rail distance be significantly greater than the wheel distance or the distance of the centers of rotation of the travelling mechanism. The width of the aisles, however, should be kept as small as possible so that as little storage space as possible is lost. The above stated prerequisite is achieved by insuring that the travelling mechanism and the guide mechanism of the vehicle are kept as short as possible. Moreover, in many cases the driving rails are positioned asymmetrically with respect to the shelf aisle distance. If this is done, however, it is not longer possible to place a rail arrangement in the center of the shelf aisle and thus no longer possible to install; a branching shunt which turns either to the right or the left.

In many cases vehicles suitable for relatively large loads cannot be used in the presence of narrow or closely adjacent storage aisles due to their long wheel distance.

SUMMARY OF THE INVENTION

It is the task of the present invention to improve a rail-mounted vehicle of the type stated in the introduction, to the extent that an especially strong apparatus suitable for transporting large loads can also be used even in cases of short distances of the parallel rails.

This is achieved according to the invention in that the travelling mechanism and the guide mechanism are provided with at least one articulation which permits bending in a horizontal plane and in that the traveling mechanism has at least two lift masts which are connected through the travelling mechanism and the guide mechanism.

Furthermore, it is advantageously provided that on each lift mast a lift carriage is drivably disposed and that the two lift carriages are drivable independently of each other.

In the case of an advantageous embodiment of the invention, the travelling mechanism has four lift masts which, together with the travelling mechanism and the guide mechanism, form two closed frames which are connected in an articulated manner through the travelling mechanism and guide mechanism sections.

Again, an advantageous embodiment of the invention provides that, in each frame, one lift carriage serving only for transporting loads travels and between the two frames a platform or the like is positioned which is, stationary in the vertical direction and provided for an operator.

Advantageously, lateral guide rollers are used at the articulations so that less lateral pressures is generated.

In a further advantageous embodiment travelling rollers are used in the articulation or articulations of the travelling mechanism, leading to a decrease of rolling pressure. This yields significant savings at the production of the drive rails and also permits use of quiet rollers of synthetic material.

Since insulating pieces are necessary when placing power leads in the upper guide rail at the shunts, it can happen that conventional shelf-stacking devices become current-less. It is therefore in many cases required to provide further complicated current conductors.

In a further preferred embodiment of the invention it is therefore provided that at at least one articulation of the guide mechanism a current collector is provided.

BRIEF DESCRIPTION OF THE DRAWINGS

In the following, different embodiments of the invention will be described in further detail, in conjunction with the Figures of the enclosed drawings, wherein:

FIG. 1 is a vertical section of a shelf-stacking device according to prior art, FIG. 1*a* is an enlarged detail from FIG. 1, FIG. 2 depicts schematically the rail arrangement and the shelf-stacking device according to FIG. 1, FIG. 3 also is a vertical section of a conventional shelf-stacking device.

DESCRIPTION OF THE PREFERRED EMBODIMENTS

Figure 3:
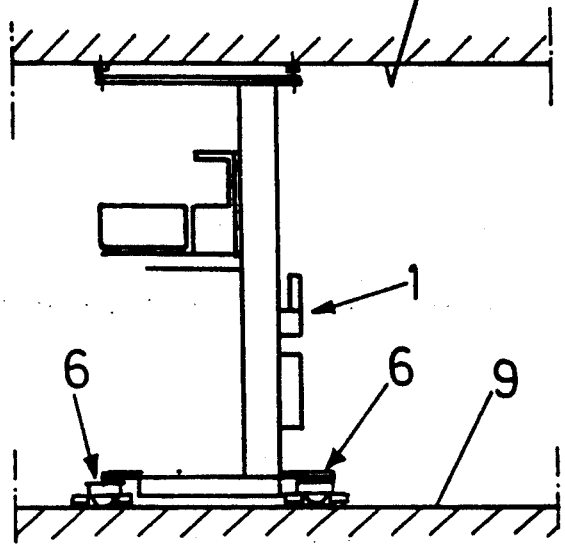
Fig.3 (PRIOR ART)

The shelf-stacking device 1 in conventional manner has a lower travelling mechanism 13, a lift mast 2, and an upper guide mechanism 3. On the lift mast 2, a lift carriage 14 is supported so as to be vertically drivable. On the lift carriage 14 is also disposed the operator cabin 10, from which the control of the guide arrangement occurs.

The guide mechanism 3 of the upper guide arrangement has upper guide rollers 4 guided in an upper guide rail 5.

The travelling mechanism 13 has one travelling mechanism body 6 each in the front and rear which in the embodiment shown in FIGS. 1 and 1*a*, carries in each instance one travelling roller 7 and two guide rollers 8. The travelling mechanism body 6 can be supported on the travelling mechanism 13 rigidly as well as also laterally displaceable or rotatably.

The guide rollers 8 are guided in a lower guide rail 9.

In FIGS. 1 and 2 a conventional shelf-stacking device 1 is shown. The shelf-stacking device 1 travels on rails 11 positioned in parallel to each other, which lead through storage aisles 15 between shelves 16 and which are connected to one another by two connecting rails 12.

Throughout the drawings, the same reference numerals are used to designate the same or functionally similar parts.

In order for the shelf-stacking device 1 to be able to travel from one rail 11 into the next rail 11, it is necessary that the wheel distance f is less than the rail distance c. The wheel distance f is measured from the center of rotation of the front and rear travelling mechanism bodies 6 supported rotatably about a vertical axis for steering.

As is evident in FIG. 2 the drive rails are disposed asymmetrically by the measure b with respect to the aisle center a. This is necessary since the lift carriage 14 of the shelf-stacking device 1 is positioned asymmetrically with respect to rail 11.

Figure 4:
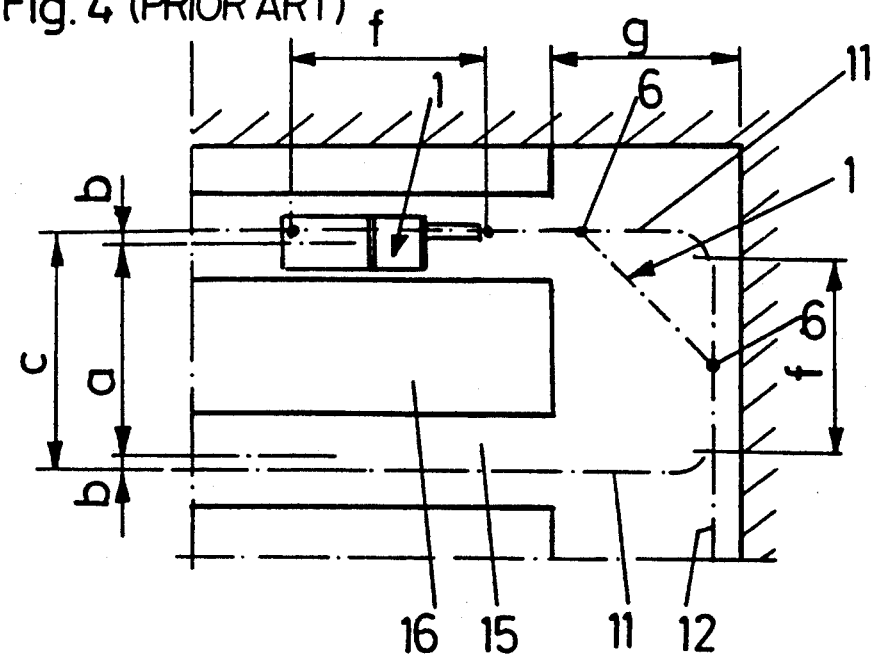
Fig. 4 (PRIOR ART)
FIG. 4 is a top view of the rail arrangement of FIG. 3.

FIGS. 3 and 4 show again a conventional shelf-stacking device 1.

Since the wheel distance f of the shelf-stacking device is too great i.e. the difference between the rail distance c and the wheel distance f is smaller than one meter, or smaller than the radius of curvature, the device cannot travel from a rail 11 into the adjacent rail 11. Such a shelf-stacking device 1 is therefore not usable.

Figure 5:
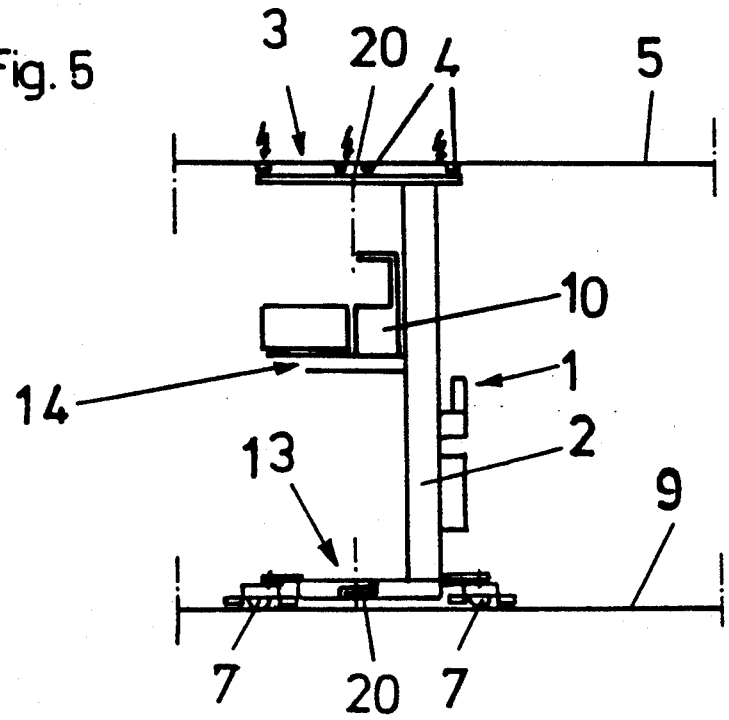
FIG. 5 is a vertical section of a vehicle according to the invention.
Figure 6:
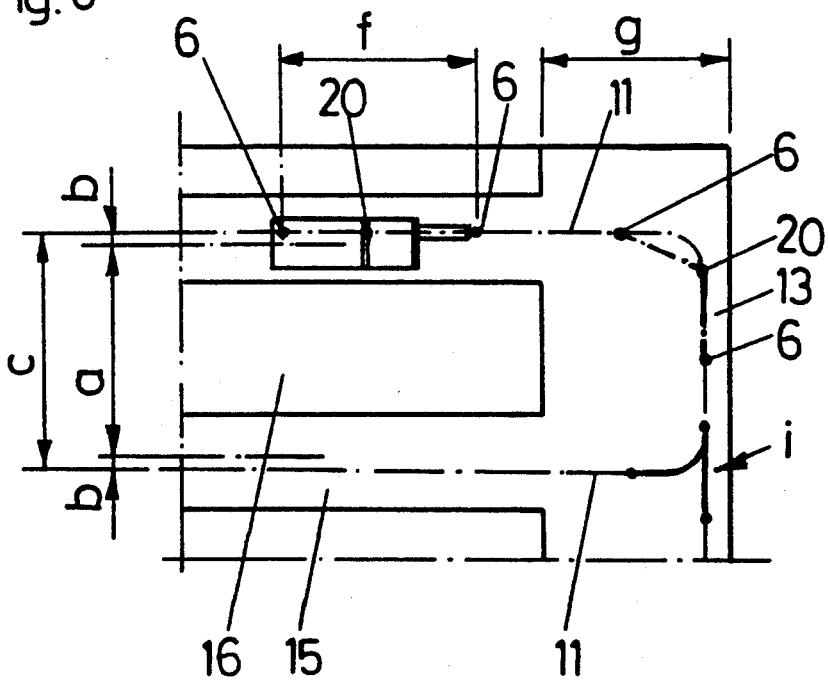
FIG. 6 depicts schematically the rail arrangement of the invention.
Figure 7:
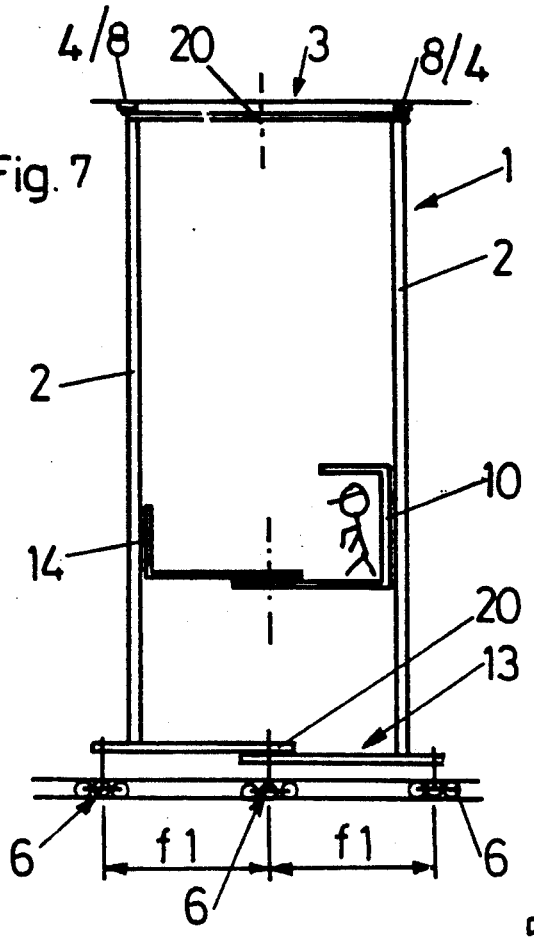
FIGS. 7–11 are vertical sections of different embodiments of the rail-mounted vehicles of the invention.
Figure 8:
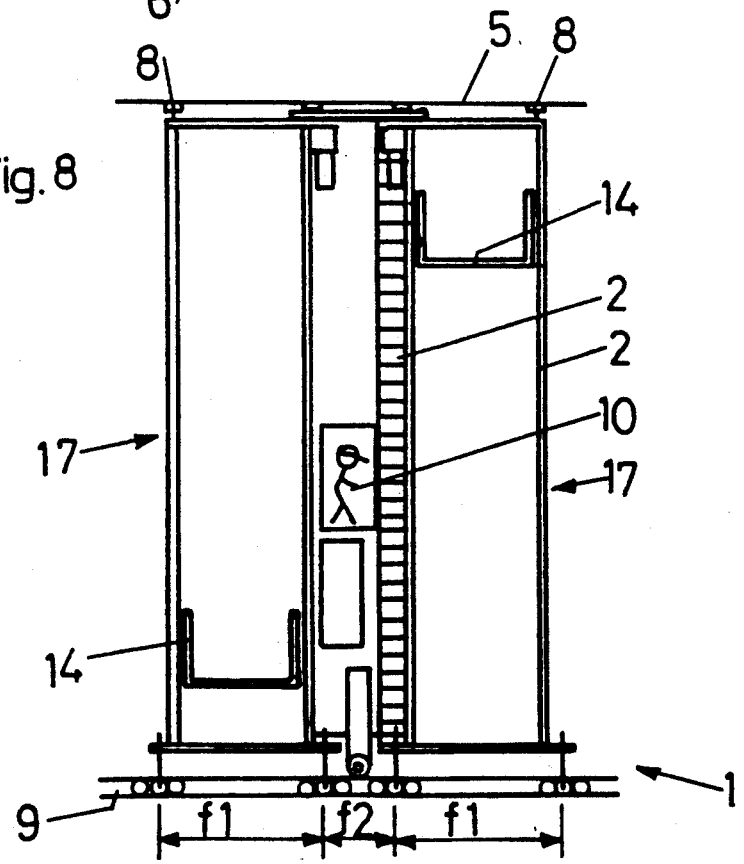
Figure 9:
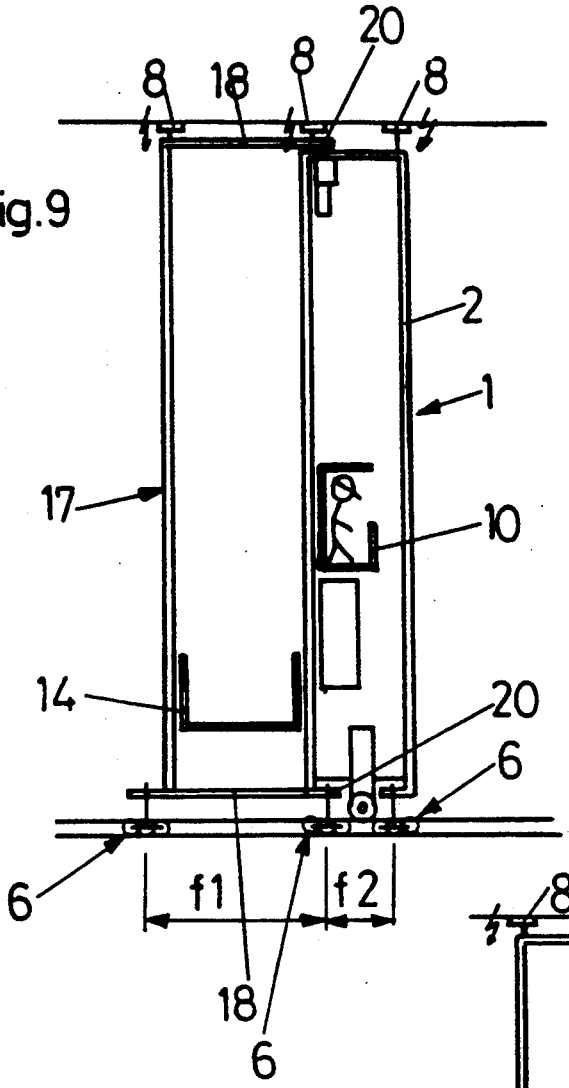

In FIG. 5 and 6 an embodiment of a shelf-stacking device 1 according to the invention is shown. According to the invention, the lower travelling mechanism 13 and the upper guide mechanism 3 are divided, and specifically at approximately the center of the travelling mechanism 13 or the guide mechanism 3, an articulation 20 is provided. Even at unfavorable ratios of f to c, for example at a ratio of 1:1, or also if f, i.e. the wheel distance, is greater than the rail distance c, the shelf-stacking device can thereby travel from one rail 11 into the adjacent rail 11.

With the articulations 20 on the travelling mechanism 13 as well as on the guide mechanism 3, guide rollers with vertical axes of rotation are disposed whereby lateral pressures are kept small. With the articulation 20 of the travelling mechanism 13, in addition, travelling rollers can also be disposed whereby the roller pressure is reduced. With the articulation 20 of the guide mechanism 3 additionally a current collector can be placed, so that the shelf-stacking device 1 does not become current-less even if the current collectors, which are on the guide rollers 8 of the front and rear travelling mechanism body 6, are at an insulation piece i between rails 11, 12.

Figure 11:
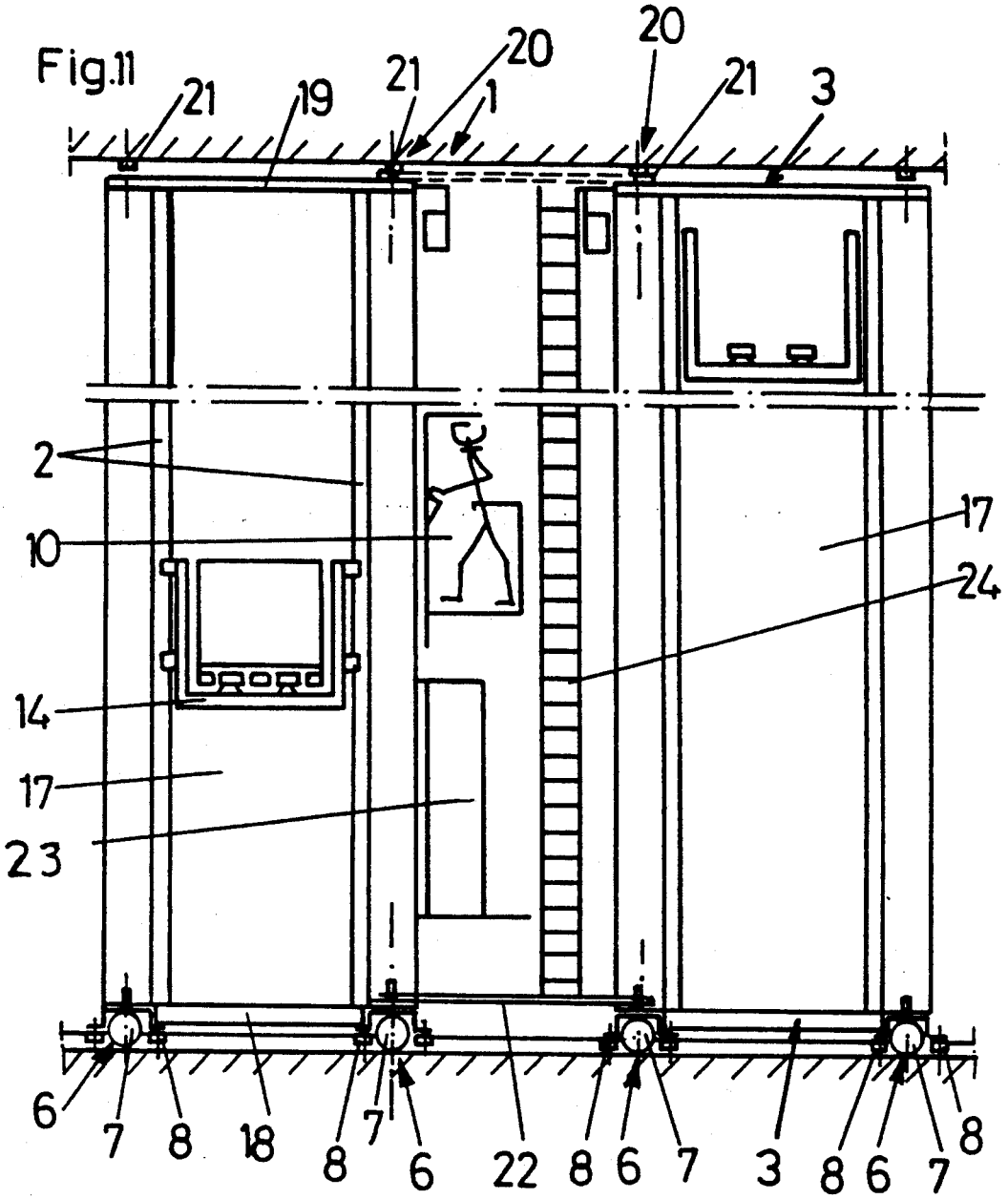
Figure 12:
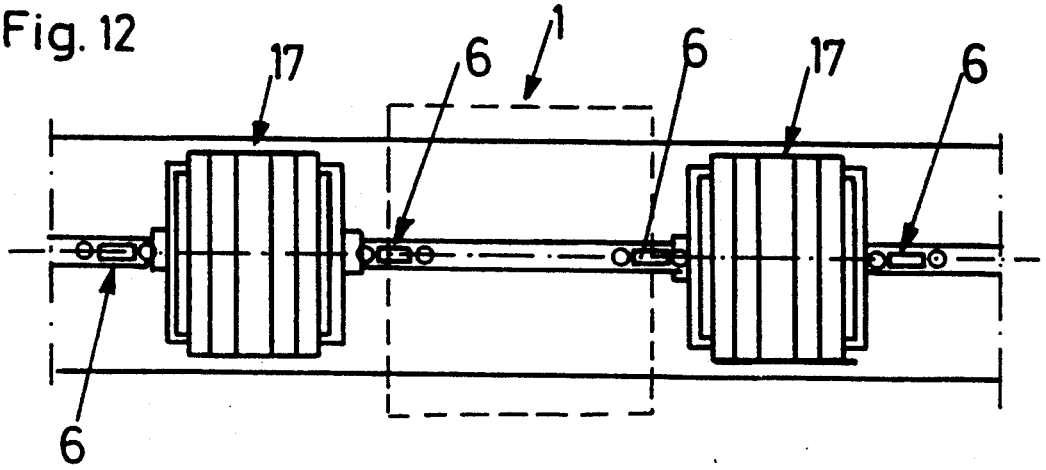
FIG. 12 is a plan top view of vehicles according to FIG. 11, and FIGS. 13–16 are each a plan view onto a vehicle according to FIGS. 11 and 12, at different stages of driving through a curve.

FIG. 11 depicts an embodiment in which the shelf-stacking device 1 comprises two frame devices 17. The frame device 17 comprises two masts 2, a lower travelling mechanism crosshead 18 and an upper guide crosshead 19. The guide crossheads 19 form together with a connecting stay 22 the guide mechanism. Two travelling mechanism crossheads 18 and one connecting stay 22 form the travelling mechanism 13. Within the frame devices 17 the lift carriages 14 move up and down on the masts 2. Each frame device 17 has two travelling mechanism bodies 6 with guide rollers 8 and a travelling roller 7. The travelling mechanism bodies 6 are each rotatably supported on a vertical axis. In the case of the guide mechanism 3 or the guide elements 18 again guide rollers 21 are provided. The guide rollers 21 are each disposed at the front and rear end of the guide crossheads 18, i.e. also in the case of articulations 20.

The frame devices 17 are connected to each other through the connecting stays 22. Consequently, the travelling mechanism and the guide mechanism are each formed by two travelling or guide crossheads 18 and one connecting stay 22 each. Between the two frame devices 17 can be disposed, if necessary, the operator cabine 10, the electrical cabinet 23, and a ladder 24. Through this arrangement a closer approach is achieved in the particular shelf aisles since the operator cabine 10 or the electrical cabinet 23 do not project and therefore are not a hindrance. The distance between the two frame devices 17 also has no influence on the favorable closeness of approach.

The lift carriages 14 can be raised independently of one another.

The driving drive proper can be provided advantageously at one of the travelling mechanism bodies 6. However, it is also possible for an intermediate drive to be disposed in the region of the stays 22. The arrangement of the driving drive has no influence on the articulation according to the invention.

Figure 13:
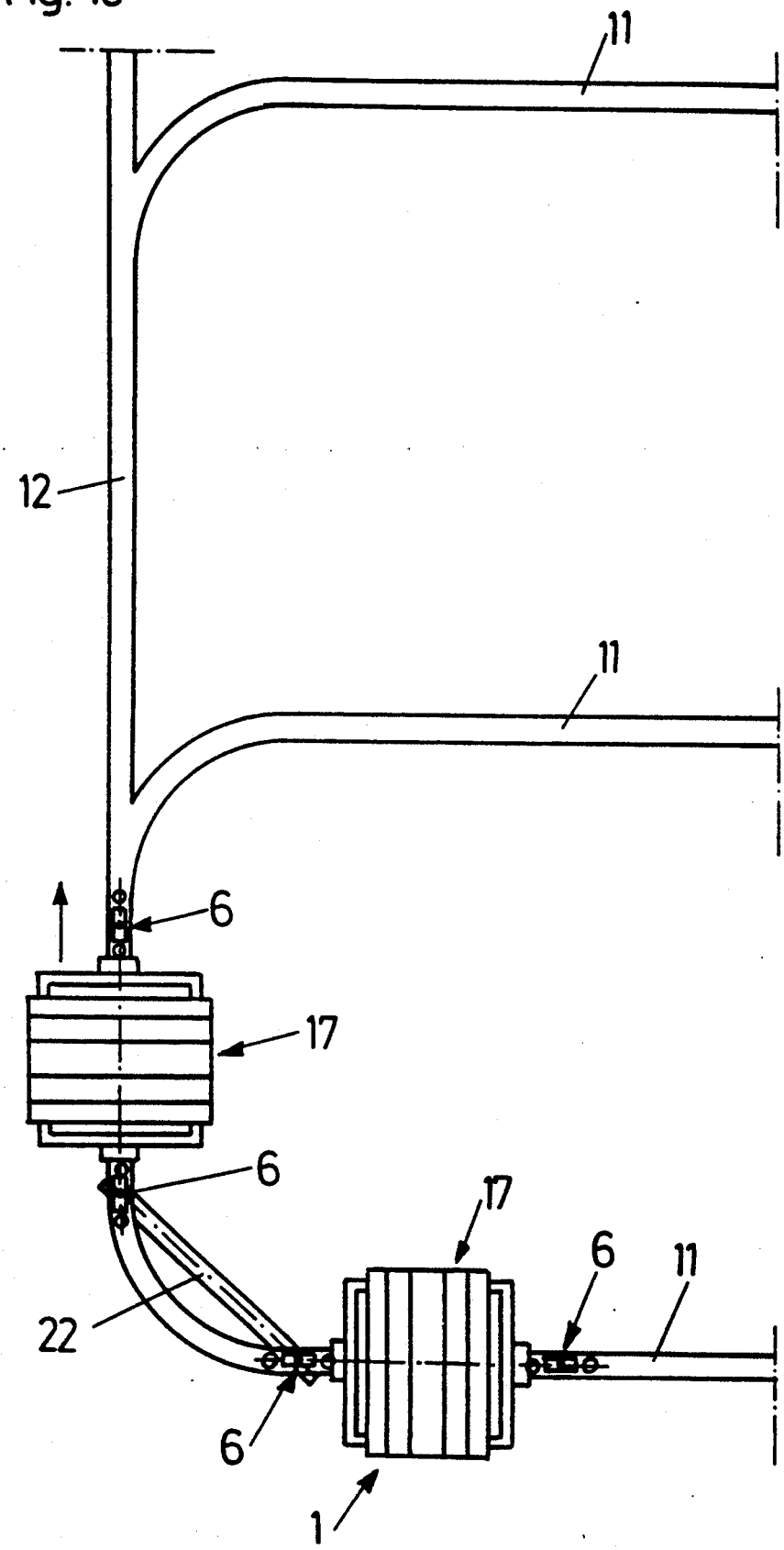

FIG. 13 shows the shelf-stacking device 1 according to the invention in the neutral position, i.e. it could turn to the right as well as also go straight at the next branch-off.

Figure 14:
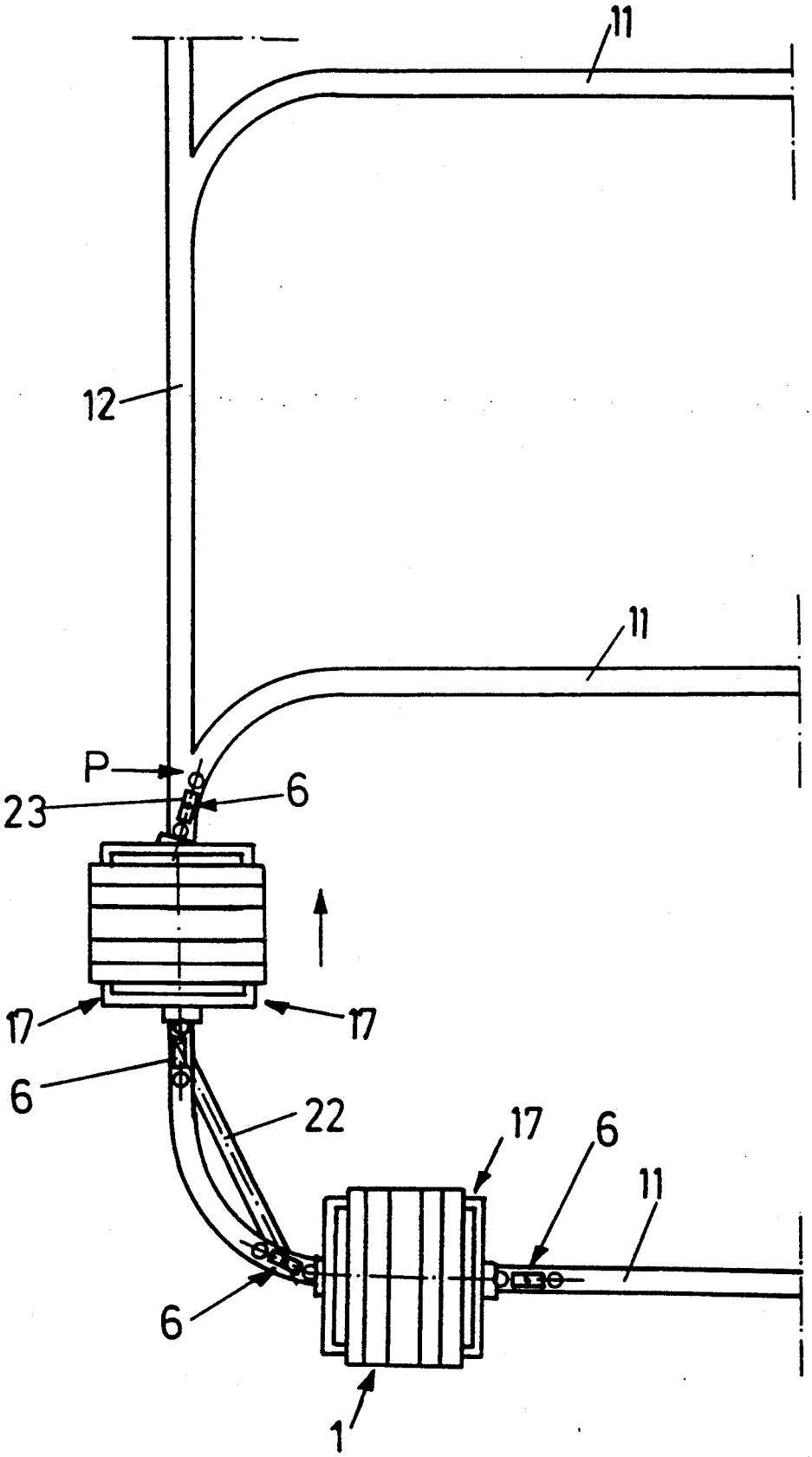

FIG. 14 shows the shelf-stacking device 1 in the position in which it turns toward the right into the rail 11. Thereby in customary manner a shunt is set or a guide arrangement is actuated. According to the invention a force P is exerted onto the travelling mechanism body 6 which is supported rotatably about the axis 23. This causes the guide roller 8 to move in the desired direction of the lower drive rail. But the selection of the direction can also take place through other known systems such as shunts, guide tongues or the like.

Figure 15:
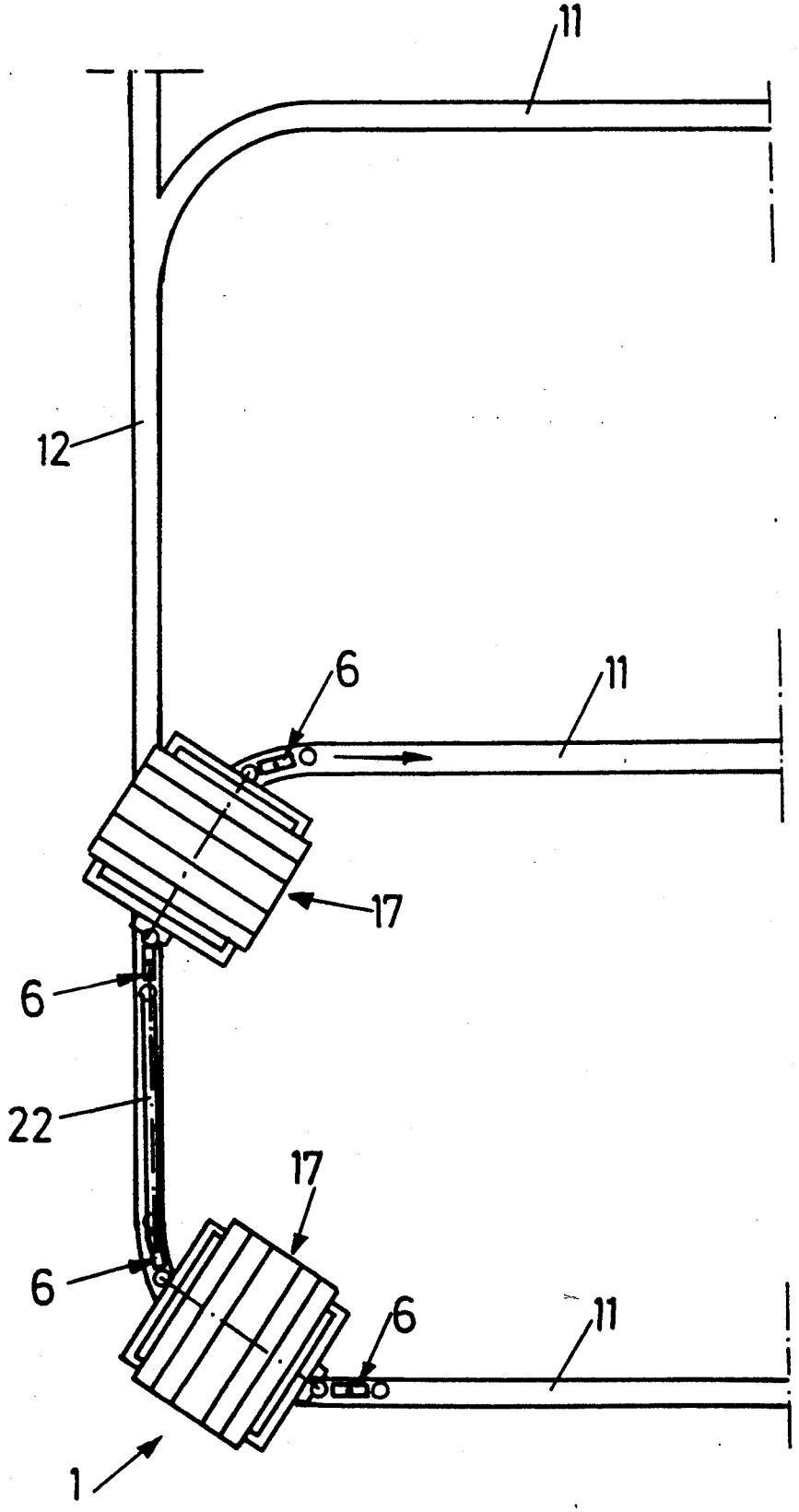

After the first travelling mechanism body 6 has determined the direction, the succeeding travelling mechanism bodies 6 follow by necessity. This situation is depicted in FIG. 15.

Figure 10:
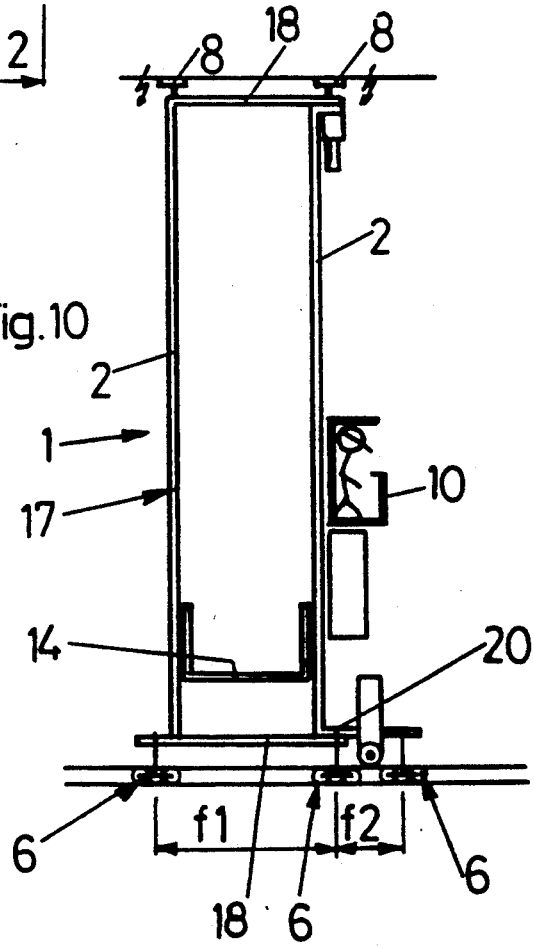
Figure 16:
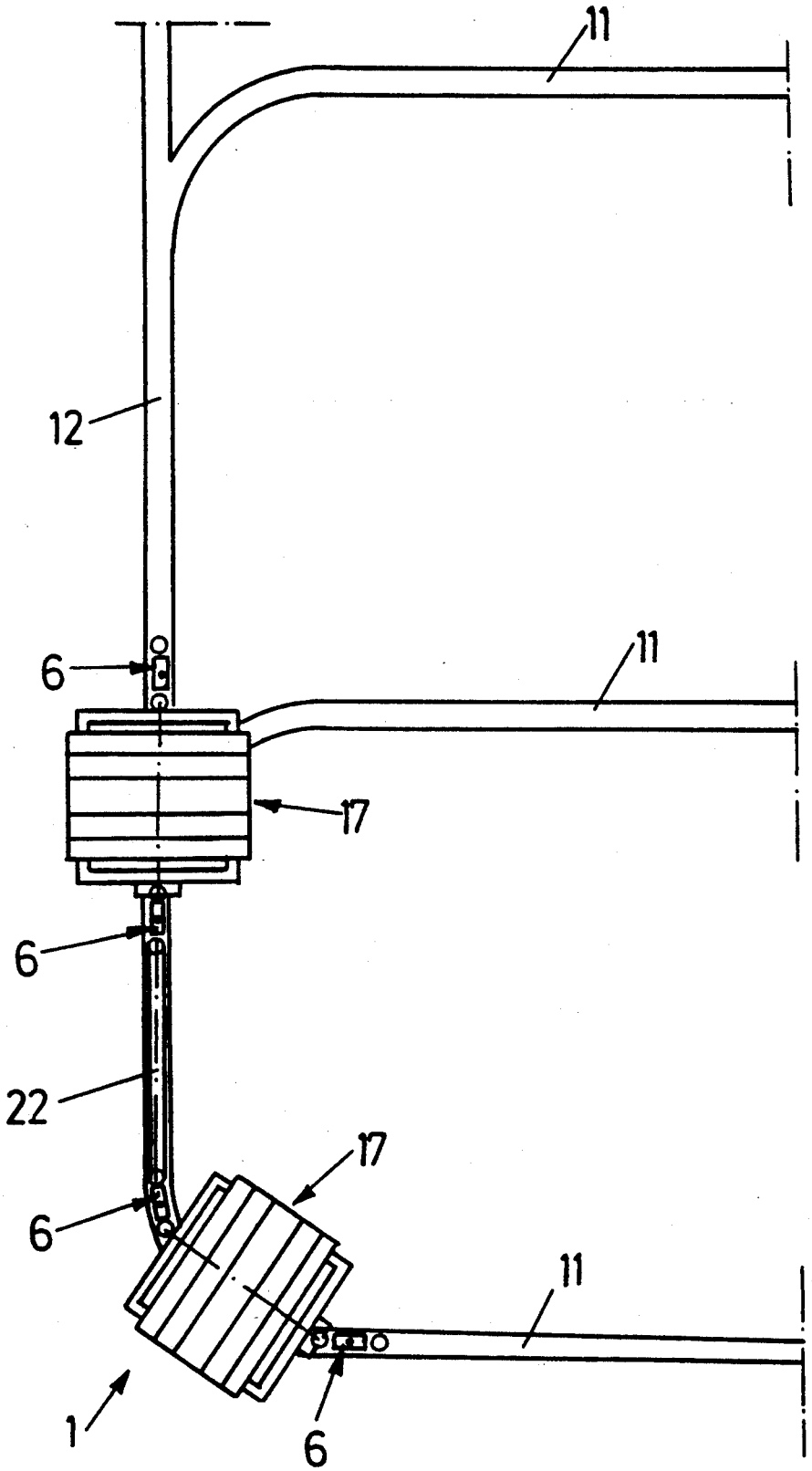

FIG. 16 depicts the situation of driving straight ahead. Since the shelf-stacking device is to drive straight ahead, no force P is exerted onto the frontmost travelling mechanism body 6. The travelling mechanism body 6 is advantageously held straight through a stop in a critical area of the lower rail. The succeeding travelling mechanism bodies 6 again follow the direction of travel determined by the first travelling mechanism body 6. FIGS. 7 to 10 show different embodiments of the shelf-stacking device according to the invention, wherein the embodiments comprise a two-mast device (FIG. 7), a two-frame device (FIG. 8), a combined frame and single-mast device (FIG. 9), and a single-frame device (FIG. 10). All of the embodiments have in common that the travelling mechanism 13 as well as also the guide mechanism 3 are provided with at least one articulation 20 permitting swivelling in a horizontal plane.

I claim:

1. A rail-mounted, high-lift stacking vehicle for travelling between an upper guide rail and a lower guide rail, comprising:

a travelling mechanism (13) for movement along a lower guide rail, said travelling mechanism including at least two spaced apart travelling mechanism bodies (6), each body including at least one travelling roller (7) for rolling along the lower guide rail;

an upper guide mechanism (3) for movement along an upper guide rail;

at least two lift masts (2) connected between said travelling mechanism and said upper guide mechanism;

a lift carriage (14) mounted for vertical displacement to at least one of said masts; and at least one articulation (20) in each of said travelling mechanism and said upper guide mechanism, for permitting a bending of each of said travelling and guide mechanisms in a horizontal plane for facilitating movement of the stacking vehicle along curves in the upper and lower guide rails.

2. A stacking vehicle according to claim 1, wherein said lift carriage is supported for vertical displacement along one of said lift masts, the vehicle including a second lift carriage supported for vertical displacement along the other of said lift masts, and drive means for vertically driving said first mentioned and additional lift carriages, independently from each other.

3. A stacking vehicle according to claim 2, wherein each of said travelling and guide mechanisms has a forward portion and a rear portion, said articulation in each of said travelling and guide mechanisms being positioned between said forward and rear portions, one of said masts and lift carriages being mounted between said forward portions of said travelling and guide mechanisms and the other of said lift carriages being mounted between said rear portions of said travelling and guide mechanisms, an additional lift mast connected between the forward portions of said travelling and guide mechanisms and an additional lift mast connected between the rear portions of said travelling and guide mechanisms, each additional lift mast being connected to said lift carriage of said respective forward and rear portions, the lift masts of each of said forward and rear portions forming with said travelling and guide mechanisms two closed frames (17) which are articulated to each other through said articulations.

4. A stacking vehicle according to claim 3, including a platform (10) for an operator connected between said two frames (17).

5. A stacking vehicle according to claim 4, wherein said platform is fixed at a vertical position between said travelling and guide mechanisms.

6. A stacking vehicle according to claim 5, wherein said articulations comprises upper and lower stays (22) pivotally mounted in a horizontal plane between said respective travelling and guide mechanisms.

7. A vehicle according to claim 6 wherein each of said two frames (17) includes two spaced apart travelling mechanism bodies each including a travelling roller for rolling along the lower guide rail, each body including at least one guide roller for rolling against the lower guide rail, said upper guide mechanism including a plurality of guide rollers for rolling along the upper guide rail.

8. A stacking vehicle according to claim 1 wherein said upper guide mechanism includes at least one guide roller for rolling along the upper guide rail, each of said travelling mechanism bodies including at least one guide roller for rolling along the lower guide rail.

9. A stacking vehicle according to claim 1 including at least one additional travelling mechanism body (6) connected to the articulation of said travelling mechanism, said at least one additional body having a travelling roller for rolling along the lower guide rail.

10. A stacking vehicle according to claim 1, including a current collector at the articulation (20) of said guide mechanism, for receiving current to power the stacking vehicle from the upper guide rail.

* * * * *